United States Patent [19]

Purkapile

[11] Patent Number: 4,569,100

[45] Date of Patent: Feb. 11, 1986

[54] VACUUM DEVICE

[75] Inventor: Emerson J. Purkapile, Chicago, Ill.

[73] Assignee: The Scott & Fetzer Company, Fort Wayne, Ind.

[21] Appl. No.: 649,534

[22] Filed: Sep. 11, 1984

[51] Int. Cl.[4] ..... A47L 9/00

[52] U.S. Cl. ..... 15/327 F; 15/327 D; 15/347; 15/352

[58] Field of Search ..... 15/327 R, 327 D, 327 F, 15/341, 347, 352

[56] References Cited

U.S. PATENT DOCUMENTS

| | | | |
|---|---|---|---|
| 2,499,183 | 2/1950 | Fairgrieve | 15/310 |
| 2,707,527 | 3/1955 | Brace | 15/347 X |
| 4,048,693 | 9/1977 | Axelrod et al. | 15/341 X |

FOREIGN PATENT DOCUMENTS

| | | | |
|---|---|---|---|
| 738555 | 10/1955 | United Kingdom | 15/327 F |

*Primary Examiner*—Chris K. Moore

*Attorney, Agent, or Firm*—Jeffers, Irish & Hoffman

[57] ABSTRACT

A vacuum device comprised of a base portion and a top portion with an expandable means, connecting the base and top portions, for moving between a contracted position and an expanded position. The expandable means and the base and top portions define a chamber therebetween. A vacuum means is mounted to the top portion for sucking debris into the chamber. Support means, which is attached to the base and top portions and passes through the chamber, selectively maintains the expandable member in its expanded position.

10 Claims, 7 Drawing Figures

VACUUM DEVICE

BACKGROUND OF THE INVENTION

The invention relates to vacuum devices, and more specifically, to vacuum devices which are portable.

As of late, vacuum devices referred to as "wet/dry vacuums" have become popular. These vacuums generally are used in a garage or workshop environment to vacuum both wet and dry debris. While these devices have proven satisfactory, they have experienced the competing interests of capacity of the vacuum chamber versus the required storage space for the vacuum. Heretofore, vacuums of an advantageously large capacity have suffered the disadvantage of requiring larger storage space. Earlier vacuum devices which have not required larger storage space have encountered the disadvantage of not having a larger capacity chamber. It would therefore be desirable to provide an improved vacuum device having a sufficiently large chamber for receiving debris as well as not requiring an undesirably large space for adequate storage.

SUMMARY OF THE INVENTION

It is therefore an object of the invention to provide an improved vacuum device having a sufficiently large chamber for receiving debris as well as not requiring an undesirably large space for adequate storage.

In accordance with one form of the invention, the invention is a portable vacuum device comprising a base member which has means for facilitating the movement of the device. The device further includes an expandable means for moving between a contracted and expanded condition. The expandable means has opposite ends and is connected at one end thereof to the base member, and at the other end thereof to a top member. The base member, top member and expandable means define therebetween a debris chamber.

The top member has mounted thereto a vacuum means for sucking debris into the chamber. A support means, which is mounted to the top and base members and essentially contained within the chamber, is movable between one position in which it maintains the expandable means in the expanded condition and another position.

The invention according to another form thereof is a vacuum device comprising a base and top portions and an expandable means for moving between a contracted and an expanded position. An expandable means along with the base and top portions define therebetween a chamber.

The device further includes a vacuum means for sucking debris into the chamber and the support means for selectively maintaining the expandable means in its expanded position.

The invention according to another form thereof is a portable vacuum device movable between an operative position in which the vacuum device is to operate and a storage position in which the vacuum device is to be stored. The device comprises a mediate bellows portion having an integral top member adjacent to one end of the bellows portion and an integral base member adjacent to the other end of the bellows portion. The top and base portions and the bellows portion define therebetween a chamber.

The vacuum means, which is mounted to the top portion, is used for sucking debris into the chamber. When the vacuum means is operating, the bellows portion is in an expanded condition. When the vacuum means is not operating, the bellows portion is in a contracted condition. The device further includes a support means for selectively supporting the bellows portion in the expanded condition.

BRIEF DESCRIPTION OF THE DRAWINGS

The above mentioned and other features and objects of the present invention, and the manner of attaining them, will become more apparent and the invention itself will be best understood by reference to the following description of an embodiment of the invention taken in conjunction with the accompanying drawings.

DETAILED DESCRIPTION OF A SPECIFIC EMBODIMENT

Figure 1:
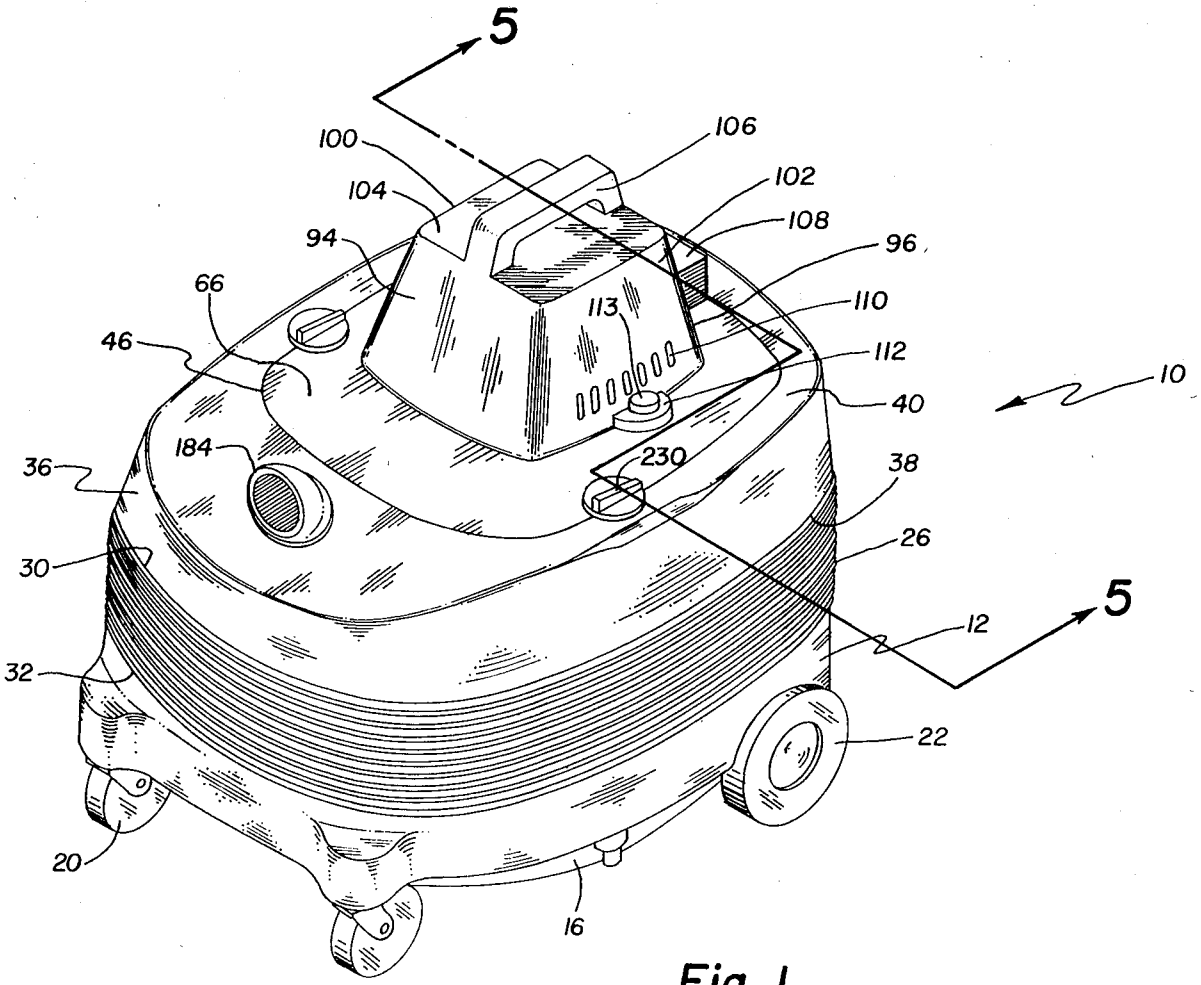
FIG. 1 is a perspective view of a specific embodiment of the invention wherein the vacuum device is shown in a contracted condition, and the hose and suction head are removed.
Figure 2:
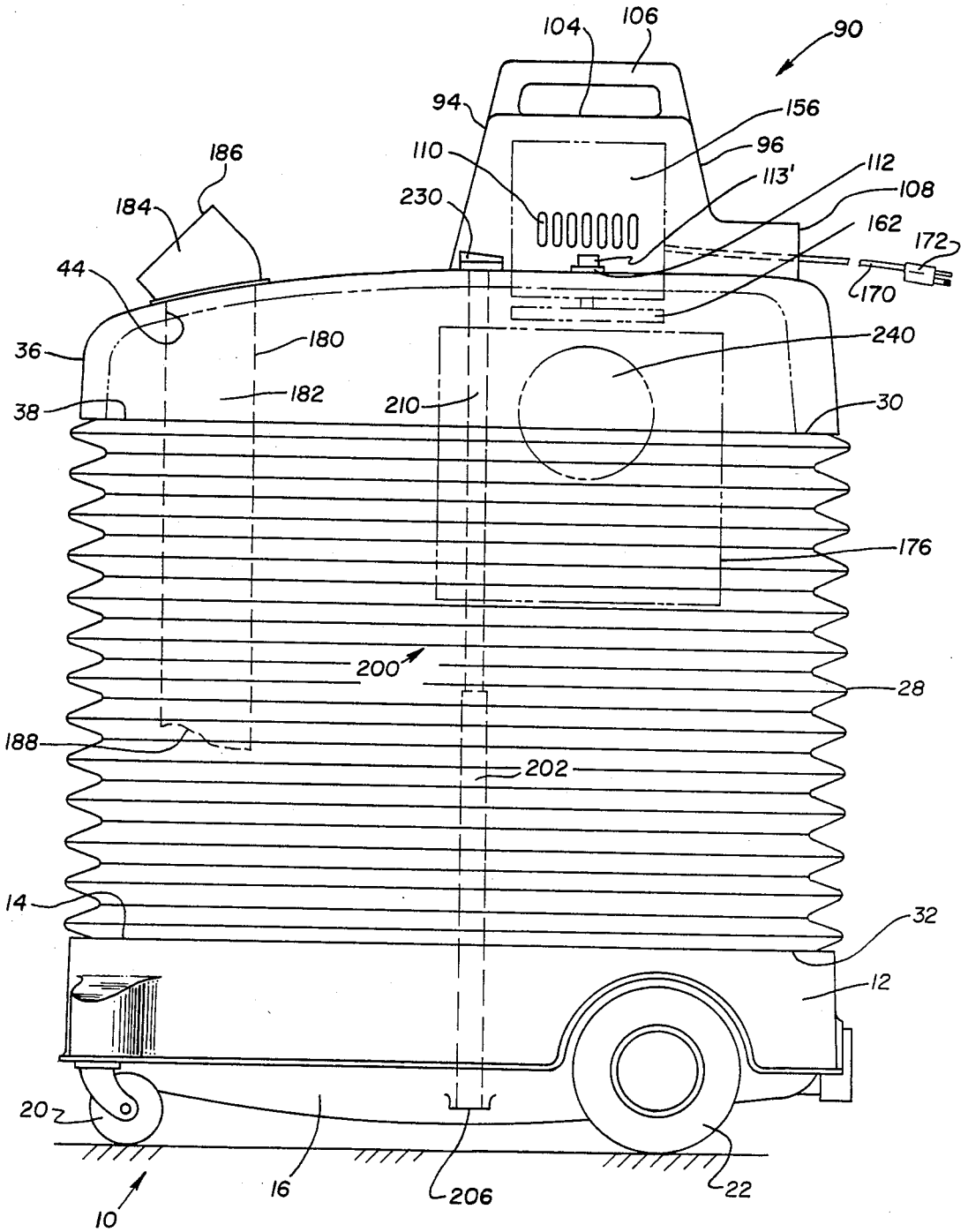
FIG. 2 is a side plan view of the vacuum device of FIG. 1 with the vacuum device being in an expanded condition.

Referring now to the drawings, there is illustrated a specific embodiment of the vacuum device 10 of the invention. The vacuum device 10 includes a base member 12 which has a top edge 14 defining an opening and a closed bottom portion 16. A set of smaller-diameter wheels 20 is rotatably attached to bottom portion 16 near one end thereof. A set of larger-diameter wheels 22 is rotatably attached to bottom portion 16 near the other end thereof.

A bellows-type expandable member 26 has a plurality of folds 28. Expandable member 26 further has a top edge 30 and a bottom edge 32. Expandable member 26 is attached at its bottom edge 32 to the top edge 14 of base member 12. Expandable member 26 is blow molded from a thermoplastic rubber material. This material is sold by Reichhold Chemicals, Inc. (Polyolebium and Vinyl Materials Division) of Hackettstown, N.J. 07840, under the trademark "TPR". "TPR" molding polymer material is very suitable for this application since it can be used by blow molders to make the expandable member 26 or the integral single piece of the expandable member 26, base member 12 and top member 36 as is mentioned below. An expandable member made from "TPR" material also would exhibit very satisfactory physical properties such as good tensile strength, impact resistance and resistance to fatigue failure. The specific grades of "TPR" material that would appear to be satisfactory for this application are the Medium Hardness Molding Grades (Nos. 1900M, 1900D, 5381 and 538R) and the Hard Molding Grades (Nos. 0720 and 0771D). A brochure entitled "TPR Selector Guide" is available from Reichhold Chemicals, Inc., and the brochure sets out certain physical properties for various grades of TPR material.

The vacuum device further includes a top member 36 which has a bottom edge 38 defining an opening and an integral top portion 40. Top member 36 has contained therein a cylindrical debris tube aperture 44 and a generally rectangular lid opening 46. A generally rectangular ledge 48 is formed at the periphery of opening 46. Ledge 48 is slightly recessed from the outer surface 50 of top member 36. The recessed ledge 48 essentially forms a receiving channel that supports a lid to be described hereinafter.

It should be understood that the base member 12, expandable member 26 and top member 36 may be manufactured as a single integral piece. This integral piece could be made, such as by blow molding, from the thermoplastic rubber material identified above. This single integral piece would include the debris tube aperture and the lid opening with ledge as described herein.

The vacuum device 10 further includes a generally rectangularly-shaped contoured lid 66. Lid 66 rests on ledge 48 so as to fit over lid opening 46. See FIG. 5. Lid 66 includes a peripheral edge 68 which is contained within the above-described receiving channel. The depth of the receiving channel is such that the top surface 70 of lid 66 is flush with outer surface 50 of top member 36. Again, see FIG. 5.

Lid 66 includes a recessed area 72. Recessed area 72 is of a generally rectangular shape. Recessed area 72 includes a generally rectangular sidewall 74 connecting the top surface 70 with a generally horizontally disposed recessed surface portion 76. An integral sloped portion 78 depends from recessed portion 76 and it terminates in an edge 80. Edge 80 defines an opening 82. Opening 82 provides access into and out of debris chamber as will become more apparent hereinafter.

Lid 66 further includes a depending integral annular support 84 having an outside cylindrical surface 86. An annular U-shaped bracket 88 is attached to outside surface 86 of support 84.

A motor assembly is generally designated as 90. Motor assembly 90 includes a motor housing 92 having a front wall 94, a rear wall 96, and opposite side walls 100 and 102. All of the aforementioned walls being joined at their top ends by top member 104. An integral U-shaped handle 106 projects from top member 104.

Motor housing 92 further includes a rearward projection 108 which extends rearwardly from rear wall 96. Side walls 100 and 102 each contain a plurality of ports 110 therein. Side walls 100 and 102 each have a mediately disposed flange 111 and 112, respectively, extending therefrom. Each flange 111, 112 contains an aperture therein. In assembling the device, the flange apertures are aligned with corresponding apertures found in the top surface. A bolt 113, 113' is then passed through each respective flange so as to mount the motor housing 92 to the lid 66.

Motor assembly 90 further includes a pair of oppositely disposed support members 114 and 116. Support member 114 has one end 118 thereof mounted to the interior of side wall 100. Support member 114 includes an upper generally horizontal portion 120 extending from end 118 and a lower generally horizontal portion 122. Upper and lower horizontal portions 120 and 122 are joined by integral vertical portion 124. Support member 114 also includes an opposite end 126. Support member 116 has one end 130 thereof attached to the interior surface of side wall 100. Support member 16 further includes an upper generally horizontal portion 132 extending from end 130 and a lower generally horizontal portion 134. Upper and lower horizontal portions 132 and 134 are joined by an integral vertical portion 136. Support member 116 further includes an opposite end 138. Support members 114 and 116 are positioned within motor housing 92 so as to be spaced apart and thereby define a channel therebetween.

Motor housing 92 further includes a lower portion 140 having a sloped side wall 142 with a free edge 144. Lower portion 140 also includes a generally horizontally disposed recessed wall 146 which is integral with side wall 142. Recessed wall 146 contains an opening 148 therein. An annular collar 150 projects from the exterior surface of recessed wall 146 and surrounds opening 148. A protective screen 152 is retained over opening 148 by annular collar 150. Lower portion 140 is attached at its free edge 142 to the bottom edge of the front, rear, and side walls of the motor housing 92.

A conventional electric motor 156 is mounted within motor housing 92. Motor 156 is attached to, or could rest on, the lower horizontal portions 122 and 134 of support members 114 and 116, respectively. It should be understood that the motor may be mounted in any number of conventional ways so that further description of the specific details of mounting the motor will not be set out herein.

Motor 156 includes a motor housing 158. A motor shaft 160 extends from housing 158. An impeller 162 is mounted to the free end of shaft 160. Impeller 162 is positioned within the volume defined by a lower portion 140 and support members 114 and 116. Impeller 162 is positioned adjacent opening 148 found in lower portion 140. Motor 156 has an electrical cord 170 extending therefrom. The cord passes through the motor housing. Cord 170 has a plug 172 on it that is compatible with connection into a conventional electrical outlet. Cord 170 is of sufficient length so as to give the vacuum device adequate mobility. Although an electric motor is illustrated and described, it should be understood that a gasoline powered motor or the like could be used as a power source to rotate the impeller as described hereinafter.

The complete motor assembly 90 rests on lid 66. Motor assembly 90 is positioned so that lower portion 140 is received within the recessed portion of lid 66. Motor housing 92 is attached to lid 66 by a bolt passing through an aperture found in each of flanges 111 and 112. See FIGS. 1 and 5.

A cylindrical filter 176 is mounted to bracket 188 so as to be contained within the debris chamber of the vacuum device.

The vacuum device further includes a float assembly which includes a float 240. Float 240 is surrounded by cylindrical filter 176. The float assembly includes an arm 242 having one end 244 attached to the float 240 and the other end 246 attached to an "on-off" switch 248. The "on-off" switch 248 is electrically connected to the motor 156 so that the motor cannot be operated when the switch 248 is in the "off" condition. The motor is capable of operation when the switch is in the "on" condition, but would not operate unless turned on by the operator. The specific construction of the float assembly and particularly the electronic connections between the "on-off" switch and the motor are of a conventional construction and are well-known in wet/dry vacuums used to pick up liquid. The pertinent feature being that the motor will not operate when the float switch assembly is in an "off" condition which signals that the canister is filled to its limit with liquid. Thus, there is no further need to describe the specific construction of the float assembly.

As can be appreciated, the purpose of the float assembly is to prevent the debris chamber from being over filled with liquid during a vacuuming operation. The operation of the float switch assembly will be described later on in this application with specific reference to FIG. 6.

Debris chamber is defined as being between base member 12, expandable member 26, and top member 36. In other words, base member 12, expandable member 26 and top member 36 could be considered collectively as a canister. The debris chamber being the interior volume of the canister.

An elongate tube 180 passes through debris tube aperture 44. Elongate tube 180 includes a straight portion 182 and an angular portion 184 as well as opposite ends 186 and 188. Elongate tube 180 is mounted to top member 36 at the juncture of the straight and angular portions. A hose 190 having opposite ends 192 and 194 is attached at end 194 to end 186 of debris tube 180. A suction head 196 is attached to hose 190 at end 192 thereof.

Figure 4A:
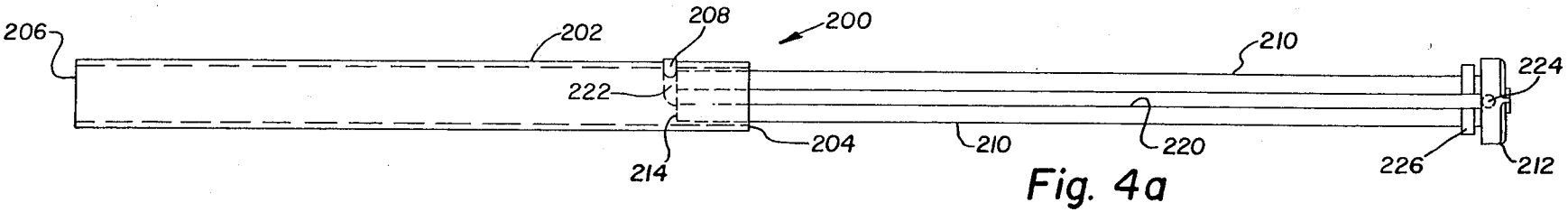
FIGS. 4*a* and 4*b* are plan views illustrating the strut assembly in an expanded-locked position and contracted position, respectively.
Figure 4B:
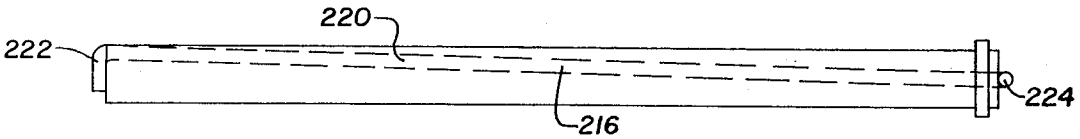

Referring more specifically to FIGS. 4*a* and 4*b*, the strut assembly 200 includes a hollow cylindrical lower strut 202 of a certain diameter. Lower strut 202 has a top end 204 and a bottom end 206. Lower strut 202 contains therein a slot 208 in the cylindrical wall thereof near end 204.

Strut assembly 200 further includes a solid cylindrical upper strut 210 of an outside diameter that is smaller than the inside diameter of lower strut 202. Upper strut 210 has a top end 212 and a bottom end 214. Upper strut 210 further includes an elongate channel 216 traveling the length of upper strut 210. The depth of channel 216 gradually increases from the left end to the right end in FIG. 4*b*. A rod 220, which includes projections 222 and 224 at the opposite ends thereof, is disposed within channel 216. A ring 226 is attached to upper strut 210 near the top end 212 thereof. Rod 220 passes through ring 226. A dial 230 is mounted to upper strut 210 near end 212 so as to engage projection 224 of rod 220 so that the rotation of dial 230 causes rod 220 to similarly rotate. Projection 222 is disposed near the end of channel 216 that is of a minimum depth.

The lower and upper struts mate in a telescoping fashion as illustrated in FIG. 4*a*. Lower strut 202 is mounted at bottom end 206 thereof to base member 12. Upper strut 210 is mounted at top end 212 thereof to top member 36. However, upper strut 210 is mounted in such a fashion that dial 230 may be easily rotated by an operator.

Figure 5:
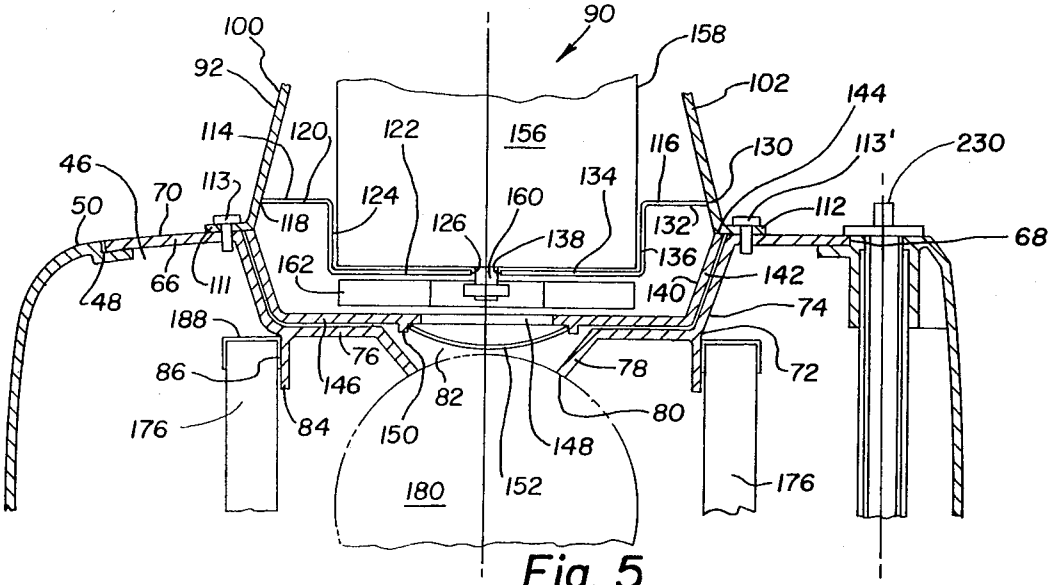
FIG. 5 is a partial cross-sectional view of the specific embodiment of FIG. 1 taken along section line 5—5 of FIG. 1.

As illustrated in FIG. 5, it should be appreciated that dial 230 overlaps the top surface of top member 36. This dial 230 thereby acts to help maintain lid 66 in position relative to upper member 36.

As an alternative to the strut assembly, a piston-cylinder assembly can be utilized. The piston cylinder assembly would be connected at one end thereof to the top member 36 and at the other end thereof to the base member 12. The piston-cylinder assembly would be biased so as to be in a normally expandable condition. The piston-cylinder assembly would include a locking mechanism that can lock the assembly in its contracted position.

The operation of the vacuum device will now be described. Dial 230 must be in a position so that projection 222 of rod 220 does not engage slot 208. Strut assembly 200 is thus in a condition so that it as well as the expandable member is free to expand. When the expandable member is expanded to a preselected point, the dial 230 is twisted and projection 222 is received within upper slot 208 so that the expandable member is now positively locked in the expanded condition.

Figure 6:
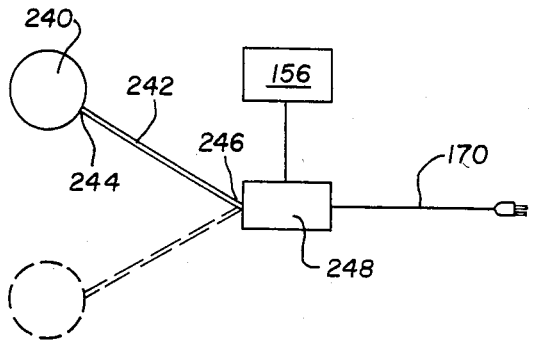
FIG. 6 is a schematic view illustrating the relationship between the float switch assembly and the motor.

Assuming there is no or little liquid in the debris chamber, the float will be in a lower position as illustrated by the dashed lines in FIG. 6. Switch 246 is thus in an "on" condition so that motor 156 can be turned on by an operator-accessible switch. When operating motor 156 creates a low internal air pressure within the chamber by evacuating air from the debris chamber through filter 176 and screen 152, and out through ports 110. The screen 152 and filter 176 protect the motor from contamination by debris or liquid found in the chamber. The filter 176 also helps protect the float switch assembly from contamination by debris or liquid. The creation of a low internal air pressure in the chamber causes atmospheric pressure to force debris through tube 180. The suction head 196 is selectively moved over the surface to be cleaned so as to suck debris from the surface into the debris chamber. As can be appreciated, the length of hose 190 can be varied to provide a greater sweeping area. The same can be said for the length of the electrical cord 170 in that a longer cord 170 will provide a greater sweeping area.

Figure 3:
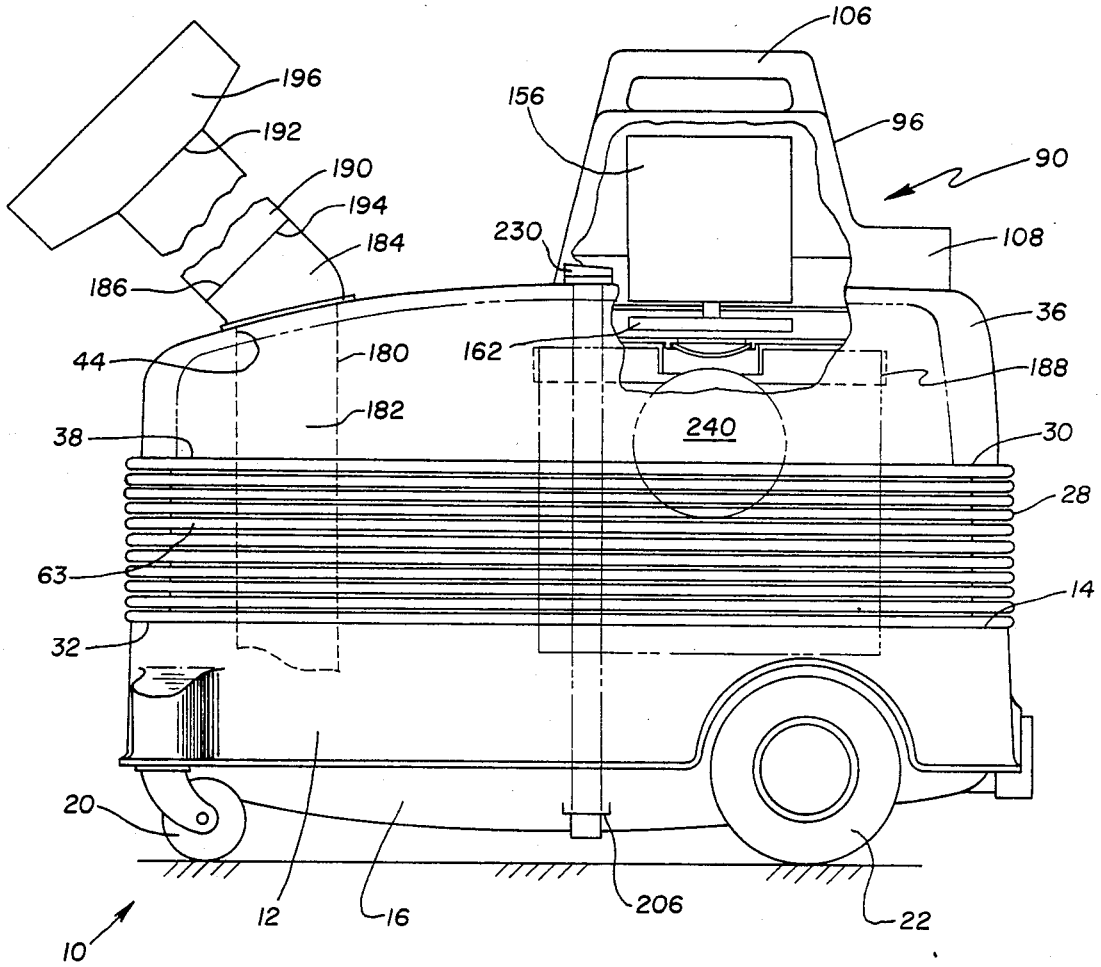
FIG. 3 is a plan view of the vacuum device in FIG. 1 with the vacuum device illustrated in a contracted condition.

When it is desired to cease the operation of the vacuum device, motor 156 is turned off by the operator-accessible switch, and depending upon the level of debris inside the debris chamber, the strut assembly is unlocked and top member 36 is pushed or falls under its own weight toward base member 12. The weight of the motor assembly and top member 36 is sufficiently great so as to maintain the vacuum device in its contracted condition generally like that illustrated in FIGS. 1 and 3. Although not illustrated, lower strut 202 could contain a plurality of longitudinally spaced-apart slots receivable of projection 222. Thus, the strut assembly could be locked at positions of different heights corresponding to various positions of compression of the vacuum device.

If during the course of operation the level of liquid reaches that level so that the float switch is positioned as illustrated by the solid lines in FIG. 6, the switch 248 will be in an "off" condition. Electrical power is not supplied to the motor when switch 248 is "off". Thus, the float switch prevents the debris chamber from being over filled with liquid. Once the debris chamber has been emptied of liquid so that switch 248 is in the "on" condition, the motor can be turned on by the operator-accessible switch.

Now that the device is in its contracted condition, it can be easily stored in a storage area that is less than the storage area required if the vacuum was in its expanded condition. Thus, it is seen that applicant has provided a vacuum device having a relatively large capacity debris chamber while at the same time the device is capable of being contracted and stored in a relatively smaller storage area.

While there have been described above the principles of this invention in connection with specific apparatus it will be clearly understood that this description is made only by way of example and not as a limitation as to the scope of the invention.

I claim:

1. A portable vacuum device comprising:

a base member having means for facilitating the movement of the vacuum device;

an expandable member movable between a contracted and an expanded condition, said expandable member having opposite ends and being connected at one end thereof to said base member and at the other end thereof to a top member, said base member, top member and expandable member defining therebetween a debris chamber;

said top member having mounted thereto a vacuum means for sucking debris into said chamber; and support means, mounted to said top and base members and essentially contained within said chamber, for moving between one position in which it maintains said expandable member in the expanded condition and another position, said support means includes a telescoping two-piece strut assembly movable between extended and contracted positions, said assembly having opposite top and bottom ends, said strut being mounted at the top end thereof to said top member and mounted at the bottom end thereof to said base member, and locking means for locking said strut assembly in the extended position.

2. The portable vacuum device of claim 1 wherein said base member comprises a bottom housing having a top edge defining an open top and a closed bottom, said expandable member connected to said bottom housing at the top edge thereof, and a set of wheels mounted to said bottom housing so as to permit the vacuum device to be rollable.

3. The portable vacuum device of claim 1 wherein said top member includes a lower edge defining an open bottom and a generally closed top, and said generally closed top having an aperture therein.

4. The portable vacuum device of claim 3 wherein said vacuum means includes a motor assembly mounted to said top member and a tube attached to said top member and passing through said aperture, said tube providing communication between the environment and said debris chamber.

5. The portable vacuum device of claim 4 further including a hose connected at one end thereof to said tube, and a sucking head connected to the hose at the other end thereof.

6. The portable vacuum device of claim 1 further including limit switch means for controlling the operation of said vacuum means when the level of liquid in said debris chamber reaches a predetermined level.

7. The portable vacuum device of claim 1 wherein said expandable member comprises a bellows member, said bellows member made from a thermoplastic rubber material.

8. A vacuum device comprising:

a base portion;

a top portion;

an expandable member movable between a contracted position and an expanded position, said expandable member and said base and top members defining a chamber therebetween;

a vacuum means for sucking debris into said chamber; and a support means for selectively maintaining said expandable member in its expanded position, said support means includes a pair of strut assemblies movable between extended and contracted positions, each strut assembly includes a plurality of telescoping struts having an uppermost strut attached to said top portion and a lowermost strut attached to said base portion, said strut assembly being extendable between an extended position in which said expandable member is in its expanded position and a contracted position, and said strut assembly having a locking assembly operable so that said strut assembly can be locked in its extended position.

9. The vacuum device of claim 8 wherein said vacuum means includes a motor-impeller assembly mounted to said to portion, and a tube passing through and mounted to an aperture in said top portion.

10. The vacuum device of claim 9 further including a limit switch means, operatively connected to said motor-impeller assembly, for shutting off said assembly when the level of liquid in the chamber exceeds a preselected level.

* * * * *

UNITED STATES PATENT AND TRADEMARK OFFICE

CERTIFICATE OF CORRECTION

PATENT NO. : 4,569,100

DATED : February 11, 1986

INVENTOR(S) : Emerson J. Purkapile

It is certified that error appears in the above-identified patent and that said Letters Patent is hereby corrected as shown below:

Claim 9, Col. 8, line 38, change "to" to --top--, second occurrence.

Signed and Sealed this

*Twenty-fourth* Day of *June 1986*

[SEAL]

*Attest:*

DONALD J. QUIGG

*Attesting Officer*

*Commissioner of Patents and Trademarks*